US011454387B2

(12) United States Patent
Johnwell

(10) Patent No.: US 11,454,387 B2
(45) Date of Patent: Sep. 27, 2022

(54) PETCUP

(71) Applicant: Phillip Eugene Johnwell, Santa Rosa, CA (US)

(72) Inventor: Phillip Eugene Johnwell, Santa Rosa, CA (US)

( * ) Notice: Subject to any disclaimer, the term of this patent is extended or adjusted under 35 U.S.C. 154(b) by 31 days.

(21) Appl. No.: 16/974,386

(22) Filed: Jan. 7, 2021

(65) Prior Publication Data

US 2021/0325033 A1 Oct. 21, 2021

Related U.S. Application Data

(60) Provisional application No. 63/101,100, filed on Apr. 17, 2020, provisional application No. 63/103,100, filed on Jul. 20, 2020.

(51) Int. Cl.

| | |
|---|---|
| ***F21V 33/00*** | (2006.01) |
| ***F21S 9/02*** | (2006.01) |
| ***A47G 19/22*** | (2006.01) |

(52) U.S. Cl.

CPC ..... *F21V 33/0036* (2013.01); *A47G 19/2227* (2013.01); *A47G 19/2288* (2013.01); *F21S 9/022* (2013.01); *A47G 2019/2238* (2013.01)

(58) Field of Classification Search

CPC .. F21V 33/0036; F21S 9/022; A47G 19/2227; A47G 19/2238

See application file for complete search history.

(56) References Cited

U.S. PATENT DOCUMENTS

| | | | | |
|---|---|---|---|---|
| 4,922,355 | A * | 5/1990 | Dietz | A47G 19/2227 362/101 |
| 5,119,279 | A * | 6/1992 | Makowsky | A47G 19/2227 362/101 |
| 10,234,131 | B2 * | 3/2019 | Lee | F21V 23/023 |
| 2014/0300273 | A1 * | 10/2014 | LeBrun | A47G 19/2227 315/76 |

* cited by examiner

*Primary Examiner* — Thomas M Sember

(57) ABSTRACT

Petcup is a new product that works as a thermo beverage cup and turned up-side down works as a portable lamp/worklight. As a hot or cold beverage cup the light can be turned on before you set it on the table giving Petcup a one-of-a-kind look. When not being used as a beverage cup, it's a portable lamp/worklight that's light-weight and can go anywhere. You can twist the top and bottom off to wash or just twist the bottom off to change the batteries. Petcup is the only cup/lamp in the world and the only cup with a dual-use as a portable lamp.

1 Claim, 2 Drawing Sheets

PETCUP

BRIEF DESCRIPTION TO THE DRAWINGS

DETAILED DESCRIPTION OF THE INVENTION

Figure 1:
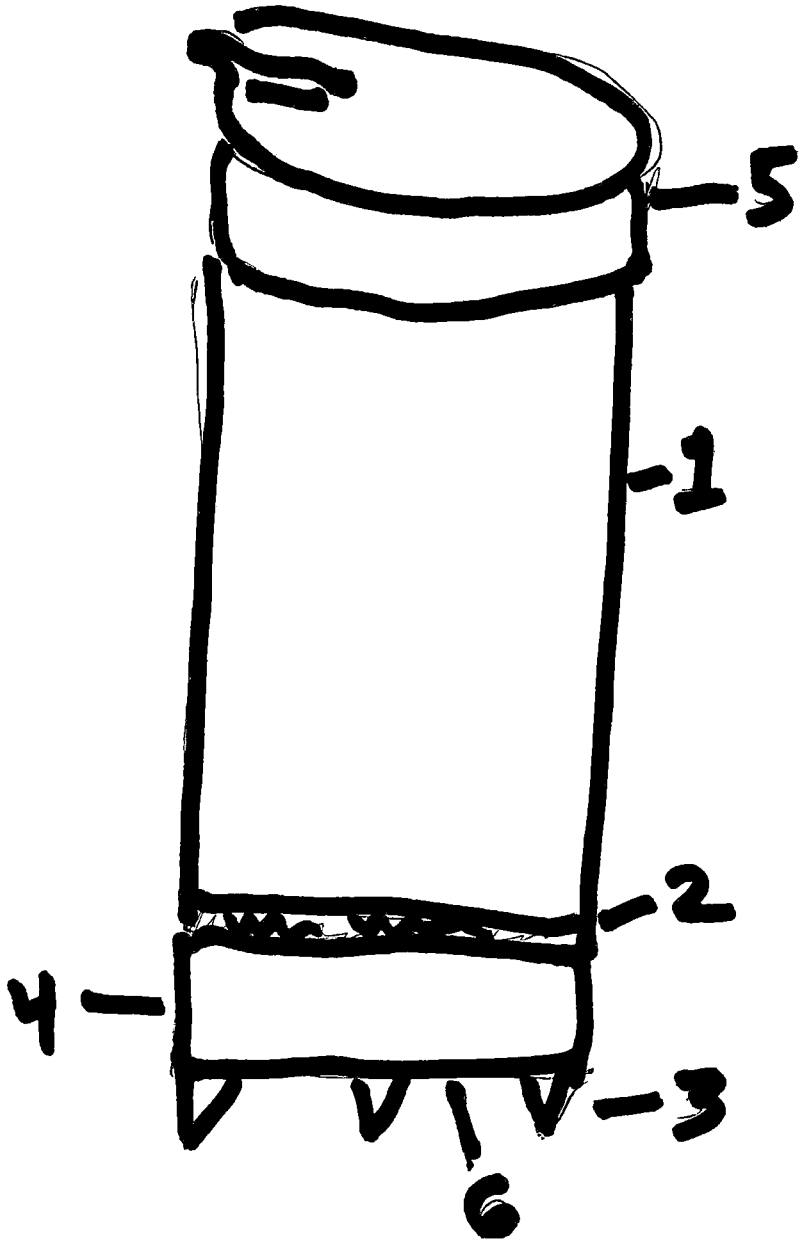
FIG. 1 is front view of the Petcup.
Figure 2:
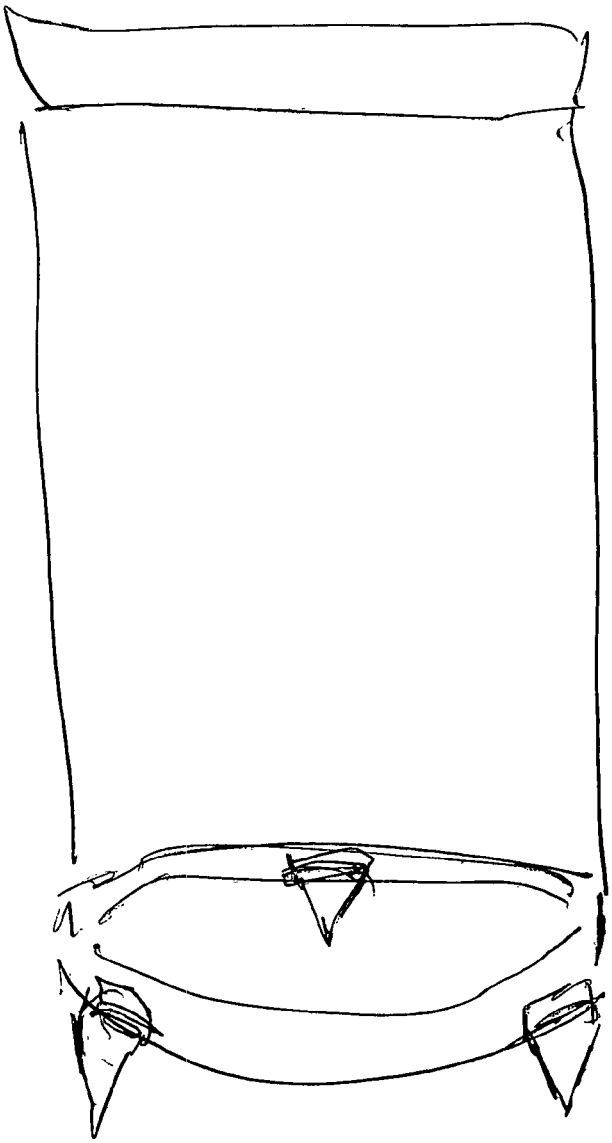
FIG. 2 is a view of the Petcup from a different angle showing the light/lamp part at the bottom of the Cup.

Petcup 1. The Hot/cold Thermo cup 1 includes a spill proof lid 5 attached to a top of the cup 1. The light adapter 2 encloses at least one battery and a light source. A bottom surface of the light adapter 2 includes a tap light switch 6. The switch 6 turns light source on and off based on a tapping motion of a user. The light adapter 2 unscrews from the bottom of the cup 1 for replacing the at least one battery. The adapter 2 further includes a plurality of casters or cup feet 3 extending downward from the bottom surface of the adapter 2. The cup feet 3 space the bottom surface of the adapter 2 from a working surface and prevents accidentally activating the tap light switch 6 and thus conserves battery power is a thermos cup that keeps hot drinks hot and cold drinks cold. With the light on it's a unique cup/ornament that nobody has seen before in their life. Petcup 1 has three casters 3 on the bottom, and an adapter 2 for connecting the bottom 4 with the Petcup 1.

If you have a cup of coffee and sit down and place this cup on a table with the light on, everybody is going to be looking at this cup because it's different and they have never seen another like it.

When not being used as a cup, Petcup, when upside down, can be used as a portable lamp and can be used as a portable work light.

By taking the spill proof top off you turn the cup upside down and it works as a portable lamp or a portable work light.

If PG&E turns off the electricity Petcup is a portable emergency lamp. Even your kids know where to find a cup. It's a great portable work light for in the attic or under the kitchen sink. For car troubles at night . . . it's a great portable work light for under the car or under the hood of a car.

Petcup is a good utility light for camping. It's a lamp in a tent as well as a cup. If you are camping you can sure use both of these.

It's a thermal cup . . . it's a portable lamp or nightlight . . . it's a portable work light and it's the only one of its kind.

The bottom 4 of the cup can be twisted off to change the batteries.

When the cup is placed on its side, it can also be used as an emergency light. Maybe you get a flat tire at night. Petcup takes the place of a flare.

When placed upside down, Petcup is as a portable lamp . . . for wherever you need a light.

When Petcup is on a countertop with the light at the bottom on, Petcup is a work of art in that it's the only cup of its kind.

Petcup can contain a cold beverage or a hot beverage such as coffee. Regardless what you put in it, it still out shines any other cup. If you are not using Petcup for a beverage, it still can be used for something else . . . a portable lamp, a portable work light . . . an emergency light. No other cup can do that.

The invention claimed is:

1. An illuminated Hot/cold Thermo cup comprising a spill proof lid attached to a top of the cup and a light adapter attached to a bottom of the cup; said light adapter enclosing at least one battery and a light source, a bottom surface of said light adapter includes a tap light switch, said switch turns the light source on and off based on a tapping motion of a user, said light adapter unscrews from the bottom of the cup so as to easily replace said at least one battery, said adapter further includes a plurality of casters or cup feet extending downward from the bottom surface of the adapter for spacing the bottom surface from a working surface and preventing accidentally activating the tap light switch, and wherein when said thermo cup is inverted and the spill proof lid is removed the cup functions as a portable night light or work light.

* * * * *